US009441483B2

(12) United States Patent
Van de Ven et al.

(10) Patent No.: US 9,441,483 B2
(45) Date of Patent: Sep. 13, 2016

(54) ADJUSTABLE LINKAGE FOR VARIABLE DISPLACEMENT

(71) Applicants: Regents of the University of Minnesota, St. Paul, MN (US); Worcester Polytechnic Institute, Worcester, MA (US)

(72) Inventors: James D. Van de Ven, Long Lake, MN (US); Shawn R. Wilhelm, Minneapolis, MN (US)

(73) Assignees: Regents of the University of Minnesota, St. Paul, MN (US); Worcester Polytechnic Institute, Worcester, MA (US)

( * ) Notice: Subject to any disclaimer, the term of this patent is extended or adjusted under 35 U.S.C. 154(b) by 358 days.

(21) Appl. No.: 14/012,677

(22) Filed: Aug. 28, 2013

(65) Prior Publication Data

US 2014/0060319 A1 Mar. 6, 2014

Related U.S. Application Data

(60) Provisional application No. 61/693,998, filed on Aug. 28, 2012.

(51) Int. Cl.

| | |
|---|---|
| ***F01B 9/02*** | (2006.01) |
| ***F04B 39/00*** | (2006.01) |
| ***F02B 75/04*** | (2006.01) |
| ***F02D 15/02*** | (2006.01) |

(52) U.S. Cl.

CPC ..... *F01B 9/02* (2013.01); *F02B 75/045* (2013.01); *F02B 75/048* (2013.01); *F02D 15/02* (2013.01); *F04B 39/0094* (2013.01); *F04B 39/0022* (2013.01); *Y10T 74/18208* (2015.01)

(58) Field of Classification Search

CPC ..... Y10T 74/18208; F04B 39/0094; F04B 39/0022; F01B 9/023; F01B 9/02; F02D 15/02; F02B 75/04; F02B 75/044; F02B 75/045; F02B 75/048

USPC ..... 92/140; 123/48 B, 78 E

See application file for complete search history.

(56) References Cited

U.S. PATENT DOCUMENTS 1,112,832 A 10/1914 Pierce
1,909,372 A 5/1933 McCollum et al.

(Continued)

OTHER PUBLICATIONS

Freudenstein, F., et al., "Development of an Optimum Variable-Stroke Internal-Combustion Engine Mechnanism From the Viewpoint of Kinematic Structure", Journal of Mechanisms, Transmissions, and Automation in Design, 105, (1983), 259-266.

(Continued)

*Primary Examiner* — Nathaniel Wiehe
*Assistant Examiner* — Logan Kraft
(74) *Attorney, Agent, or Firm* — Schwegman Lundberg & Woessner, P.A.

(57) ABSTRACT

An apparatus comprising a crank-slider linkage and a rocker link. The crank-slider linkage has a crank coupled to the slider by a jointed connecting rod. The jointed connecting rod has a first link and a second link. The first link is coupled to the second link by a first revolute joint. The first link is coupled to the crank and has a longitudinal axis. The rocker link has a rocker end and a ground end. The rocker end is coupled to the jointed connecting rod. The ground end is coupled to ground by a second revolute joint. The rocker link and the second link are disposed on a common side of the longitudinal axis.

20 Claims, 4 Drawing Sheets

(56) References Cited

U.S. PATENT DOCUMENTS

| | | | | | |
|---|---|---|---|---|---|
| 1,912,604 | A | | 6/1933 | Valentine | |
| 2,821,926 | A | | 2/1958 | Miller et al. | |
| 2,822,791 | A | | 2/1958 | Biermann | |
| 2,909,163 | A | | 10/1959 | Bermann | |
| 2,909,164 | A | * | 10/1959 | Biermann | F02B 75/048 123/48 B |
| 3,686,972 | A | | 8/1972 | McWhorter | |
| 4,131,094 | A | * | 12/1978 | Crise | F02F 7/0019 123/48 B |
| 4,270,495 | A | | 6/1981 | Freudenstein et al. | |
| 4,437,438 | A | * | 3/1984 | Mederer | F01B 9/02 123/197.3 |
| 4,500,262 | A | | 2/1985 | Sugino et al. | |
| 5,335,632 | A | * | 8/1994 | Hefley | F02B 75/048 123/48 B |
| 6,604,495 | B2 | | 8/2003 | Moteki | |
| 6,938,589 | B2 | * | 9/2005 | Park | F02B 75/048 123/48 B |
| 7,811,064 | B2 | | 10/2010 | Allen | |
| 8,386,040 | B2 | | 2/2013 | Pate et al. | |
| 8,408,171 | B2 | | 4/2013 | Tanaka et al. | |
| 8,459,970 | B2 | | 6/2013 | Johnston | |

OTHER PUBLICATIONS

Wilhelm, S. R., et al., "Synthesis of a Variable Displacement Linkage for a Hydraulic Transformer", Proceedings of the ASME 2011 International Design Engineering Technical Conferences & Computers and Information in Engineering Conference (IDETC/CIE 2011), (2011), 8 pgs.

* cited by examiner

ADJUSTABLE LINKAGE FOR VARIABLE DISPLACEMENT

CLAIM OF PRIORITY

This patent application claims the benefit of priority under U.S. Provisional Patent Application Ser. No. 61/693,998, filed on Aug. 28, 2012, which is hereby incorporated by reference herein in its entirety.

STATEMENT REGARDING FEDERALLY SPONSORED RESEARCH OR DEVELOPMENT

This invention was made with Government support under EFRI-1038294 awarded by the National Science Foundation. The Government has certain rights in the invention.

BACKGROUND

A variable displacement hydraulic pump or motor promises the potential for energy savings over throttling valve control. However, the efficiency of variable displacement machines can decrease significantly at low displacement. This can result in poor efficiency for applications operating at partial load for the majority of the cycle. Example applications include hydraulic hybrid vehicles, hydrostatic transmissions for wind power, and the unique application of compressed air energy storage using a liquid piston. Thus, there is a general need to develop a hydraulic pump or motor with high efficiency across the full displacement range.

Previous variable displacement machines have utilized planar joints that suffer from a trade-off between high mechanical friction and high leakage to maintain hydrodynamic bearings. Some examples of linkages, such as the Stephenson III and the Watt II, are unable to achieve zero displacement.

OVERVIEW

A variable displacement hydraulic pump or motor having high efficiency at all operating conditions, including low displacement, can be beneficial to multiple applications. Two energy loss terms in conventional pumps are the friction and lubrication leakage in the kinematic joints. An example of the present subject matter includes a variable displacement six-bar crank-rocker-slider mechanism that uses low friction pin joints. Example linkages can reach zero or near zero displacement with a constant top dead center (TDC) position (or bottom dead center, BDC position), reducing or minimizing compressibility energy losses. In one example, the present subject matter provides a range of motion for a base four-bar crank-rocker, and includes a method of making an output slider dyad. The analysis provided explains mechanism performance including transmission angle, slider stroke, mechanism footprint, and timing ratio.

The present inventors have recognized, among other things, that previous linkages are unable to achieve a zero displacement in a variable displacement mechanism. An example presented herein includes a solution to this problem including a planar, six-bar linkage having a rocker link with an adjustable joint position at a ground reference.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
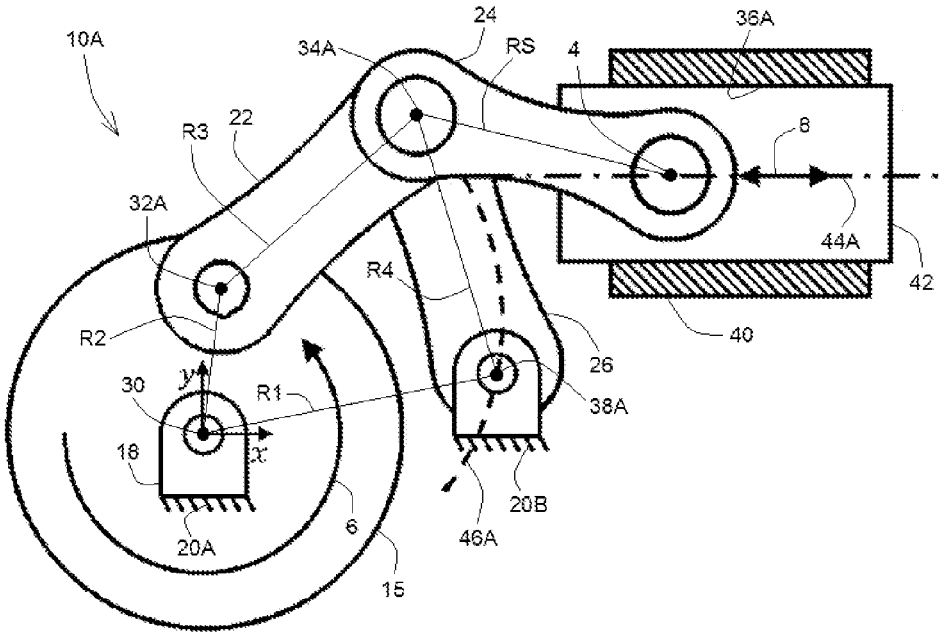
FIG. 1 illustrates an adjustable linkage, according to one example.

FIG. 1 illustrates a variable displacement slider linkage as part of system 10A. Rotary shaft 15 turns on revolute joint 30. Revolute joint 30 is affixed to ground 20A by journal 18. Revolute joint 32A, sometimes referred to as a crank pin, is offset from joint 30 by link R2. In this sense, link R2 represents a crank that is configured for rotary motion about a center axis coaxial with joint 30, as shown by arrow 6. Direction of rotation can be in the direction shown by arrow 6 or in the opposite direction. Coordinate system x and y has an origin coaxial with joint 30.

Link R2 is connected to a first end of coupler link 22 at joint 32A. Coupler link 22, which can be modeled by link R3, is coupled to revolute joint 34A at a second end. A longitudinal axis of coupler 22 passes through the center of joint 32A and the center of joint 34A and is coincident with the line denoted in the figure as R3.

Revolute joint 34A is connected to a first end of connecting rod 24. Connecting rod 24, which can be modeled by link RS, is coupled to slider joint 36A by revolute joint 4. Revolute joint 4 is sometimes referred to as a wrist pin when associated with a piston. Slider joint 36A, sometime referred to as a prismatic joint, can include piston 42 slidably engaged with cylinder 40. Slider joint 36A has a single degree of freedom along center axis 44A and allows movement as indicated by double-ended arrow 8. Slider joint 36A can include a linear bearing and, in the example shown, slider joint 36A refers to the interface of piston 42 and cylinder 40. In one example, piston 42 and cylinder 40 define a variable displacement chamber.

Revolute joint 34A is coupled to a first end of rocker link 26. Rocker link 26, which can be modeled by link R4, is coupled to ground 20B at revolute joint 38A. Ground 20A and ground 20B share a common frame of reference but are distinguishable to the extent that a distance between ground 20A and ground 20B can be selected or adjusted, in which case, these can be viewed as a prismatic joint. Similarly, and in various examples, cylinder 40 is tied to ground which can include ground 20A, ground 20B, or another frame of reference.

The combination of link R1 (common ground between joint 30 and joint 38A), link R2, link R3, and link R4 can be viewed as a four-bar crank-rocker mechanism having an input crank, a coupler link, and a rocker link.

In the example shown, the position of the joint 38A can be adjusted through dashed arc 46A. Arc 46A is centered on a point not shown in FIG. 1. Connecting rod 24 joins slider joint 36A to the base four-bar at the coupler point denoted here as joint 34A. This configuration can be viewed as a rocker slider dyad. The combination of the four bar crank rocker and slider dyad create a six bar crank-rocker-slider.

Translation (or displacement) of slider joint 36A is determined by the position of joint 38A relative to center axis 44A of slider joint 36A. In particular, when joint 38A is positioned collinear with center axis 44A, no translation of slider joint 36A occurs. With increasing distance between joint 38A and center axis 44A, displacement of slider joint 36A increases in response to rotation of rotary shaft 15.

System 10A also exhibits a uniform stroke end position of slider joint 36A that is independent of the position of adjustable link 38A and independent of the displacement of slider joint 36A. The stroke end position can be a TDC position or a BDC position. In the example shown, without regard to the position of adjustable link 38A, slider joint 36A returns to the same TDC position at the left-most end of the stroke travel (assuming the cylinder head is on the left-most end of cylinder 40). In the case of a fluid pump, the deterministic and consistent TDC position of the slider joint 36A means that nearly all of a working fluid can be ejected on every stroke of a piston to minimize compressibility losses.

System 10A can be implemented as a motor or as a pump. For example, a linear reciprocating power supply, such as a pitman arm or a piston in a cylinder of an internal combustion engine, can be coupled to slider joint 36A and produce a rotary output at shaft 15. In another example, rotary power coupled to shaft 15 can be converted to linear reciprocating power at slider joint 36A. When implemented as a pump, the fluid flow driven by slider joint 36A can go to zero with continuous rotation of shaft 15.

Rotary shaft 15 can be driven by a prime mover such as an electric motor, a wind turbine, or other source of rotary power.

In the example shown, joint 30 is off-axis relative to center axis 44A and has a crank-slider configuration sometimes referred to as offset. In other examples, joint 30 is coaxial with center axis 44A and has a crank-slider configuration sometimes referred to as inline.

FIGS. 2A, 2B, 2C, and 2D illustrate configurations for various examples of the present subject matter. In the examples shown, the linkage is able to reach zero displacement at the slider joint. For the slider joint to have zero displacement, the ground connection point is aligned with the center axis of the slider joint. In this manner, the coupler point will not impart translation on the slider joint. If a four-bar crank-rocker mechanism is configured such that the coupler link curve is a pseudo arc, and the slider pivot is placed at the center of this arc, then the slider of the resultant six-bar linkage will have approximately zero displacement. If the ground pivot of the rocker link of the base four-bar is moved, the coupler curve deviates from an arc and causes the slider joint to move.

Figure 2A:
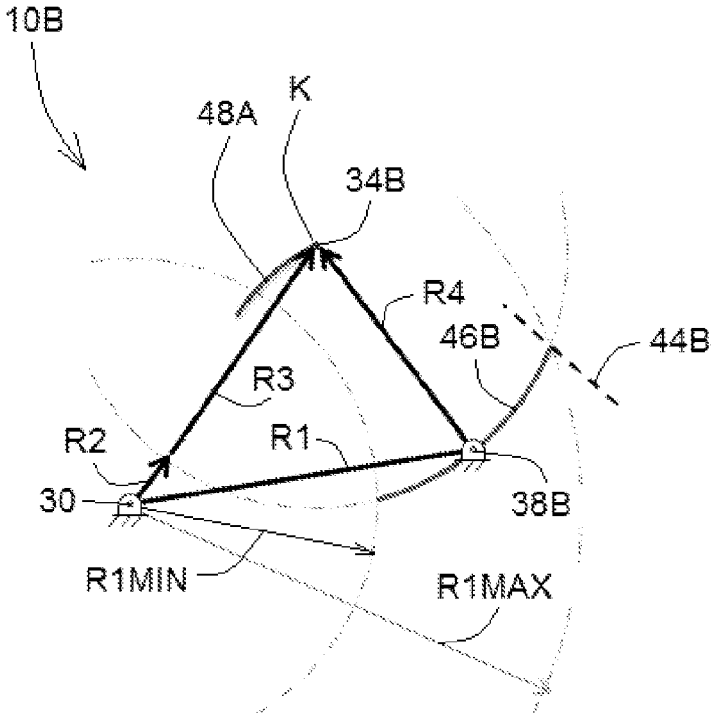
FIGS. 2A, 2B, 2C, and 2D illustrate linkage configurations, according to various examples.

In FIGS. 2A-2D, the dimensions of R1MIN and R1MAX are determined by the law of cosines and a defined minimum transmission angle as to R3 and R4. The minimum transmission angle is selected to avoid binding of the linkage. In FIG. 2A, for example, link R1 can have a minimum dimension of R1MIN and a maximum dimension of R1MAX corresponding to an endpoint at joint 38B on arc 46B. In this configuration, joint 34B (represented by point K) travels in a circular arc 48A with radius determined by the length of link R4 about joint 38B.

To create an arc of joint 38B that can be associated with TDC (or BDC), point K is located at either end of the coupler link curve, shown in FIG. 2A as arc 48A. This corresponds to configurations where link R2 and link R3 are collinear in either the extended case (shown in system 10B in FIG. 2A and system 10C in FIG. 2B) or in the overlapping case (shown in system 10D in FIG. 2C and system 10E in FIG. 2D). The collinear condition ensures that the coupler link curve represents the extreme positions of the rocker link, which controls the slider joint position of TDC and BDC.

With R1MIN, R1MAX, and the location of TDC defined, the arc of acceptable ground pivots can be determined. The adjustable ground pivot, at joint 38B in FIG. 2A, must fall on a section of the arc of radius R4 centered at K that falls between the circles of radius R1MIN and R1MAX centered at the origin at revolute joint 30. This configuration is satisfied by two arcs, both of which are valid as they result in a mirror image of the same linkage.

Link R1 can be set to either R1MIN or R1MAX when determining the location of zero displacement. As such, the ground position of R4 (seen as joint 38B in FIG. 2A) associated with zero displacement is located at an extreme of arc 46B of acceptable ground pivot positions. This configuration allows maximum travel of joint 38B as it moves to the opposite extreme of arc 46B, which results in maximum variability of the linkage.

The angle of axis of the slide joint (shown as center axis 44B in FIG. 2A) affects the maximum displacement and transmission angle. Because the center axis of the slider joint can be defined with the linkage in the extended case or in the overlapped case and at R1MIN or R1MAX, there are four configurations in which the linkage can be constructed which are shown in FIGS. 2A, 2B, 2C, and 2D.

FIG. 2A illustrates system 10B corresponding to the extended case where R2 (crank link) and R3 (coupler link) are endwise additive and center axis 44B is intersected by arc 46B at R1MAX. In the example shown, if revolute joint 38B is aligned collinear with axis 44B, the slider joint exhibits zero displacement with rotation of link R2.

Figure 2B:
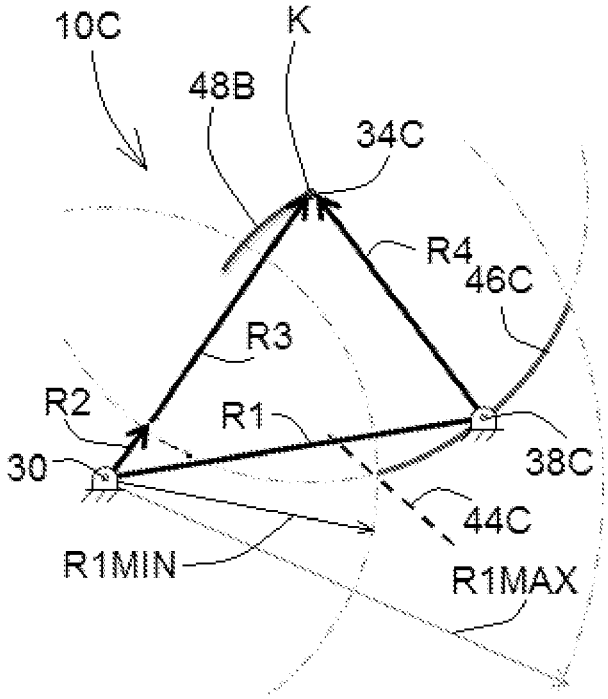

FIG. 2B illustrates system 10C corresponding to the extended case where R2 (crank link) and R3 (coupler link) are endwise additive and center axis 44C is intersected by arc 46C at R1MIN.

Figure 2C:
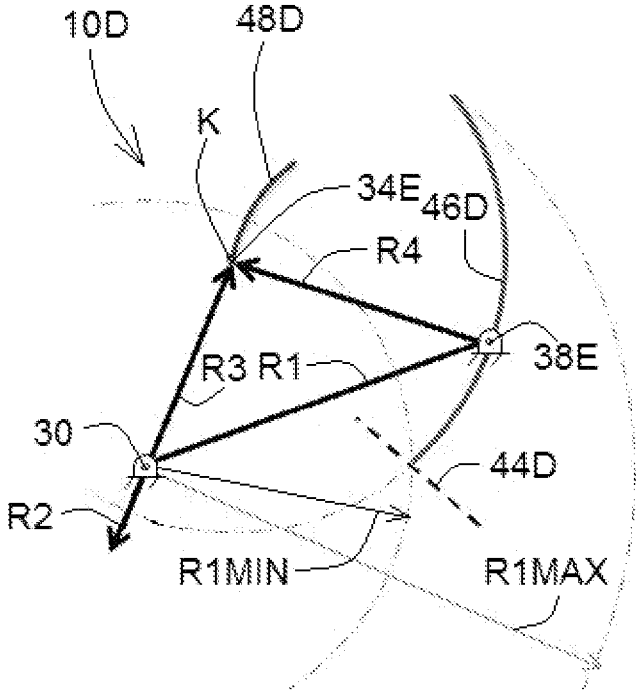

FIG. 2C illustrates system 10D corresponding to the overlapped case where R2 (crank link) and R3 (coupler link) are endwise opposing and center axis 44D is intersected by arc 46D at R1MIN. System 10D illustrates an alternate view of system 10A illustrated in FIG. 1.

Figure 2D:
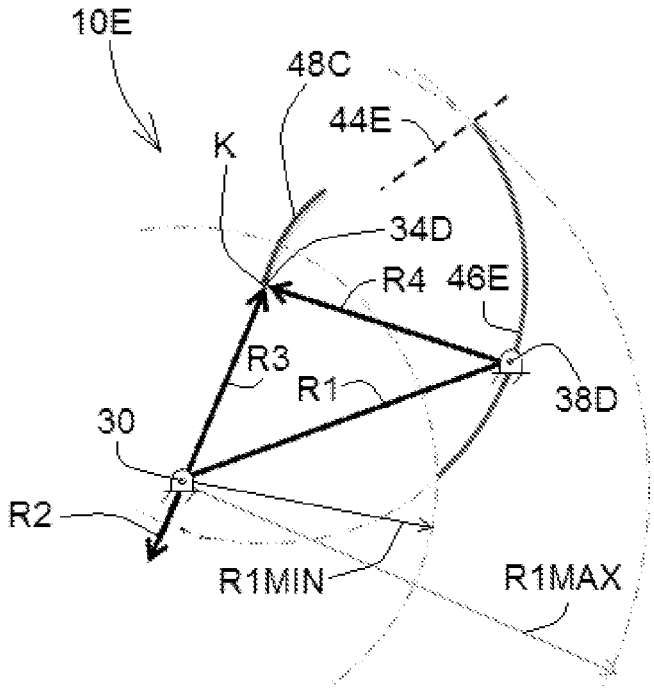

FIG. 2D illustrates system 10E corresponding to the overlapped case where R2 (crank link) and R3 (coupler link) are endwise opposing and center axis 44E is intersected by arc 46E at R1MAX.

In one example, the slider dyad configuration includes a connecting rod having a length equal to that of the rocker link. In each of the foregoing examples, one end of the connecting rod is pinned to the base four-bar at point K, and the other end is pinned to the slider joint that travels along the center axis of the slide. When the grounded end of the rocker link is coincident with the center axis of the slider joint, no translation is imparted to the slider because K travels in an arc about the slider joint. As the grounded end of the rocker link moves away from the center axis of the slider joint, the path of K varies. As a result, the slider joint is translated along the axis.

Figure 3:
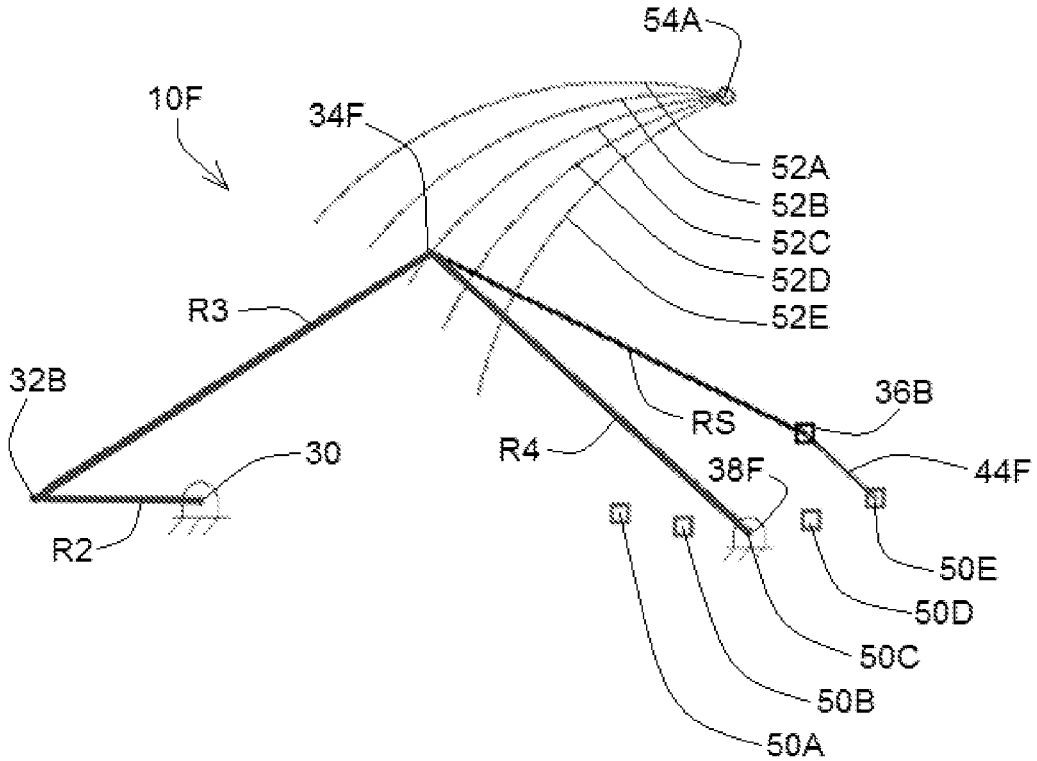
FIG. 3 illustrates a linkage configuration, according to one example.

FIG. 3 illustrates various configurations of one example. FIG. 3 illustrates system 10F having crank R2 affixed to ground at revolute joint 30. System 10F illustrates an alternate view of system 10B illustrated in FIG. 2A. Revolute joint 30 can include a bearing journal or a motor shaft. Coupler link R3 is affixed to link R2 at revolute joint 32B. In addition, coupler link R3 is connected to a first end of rocker link R4 and a first end of connecting rod link RS at revolute joint 34F. A second end of connecting rod link RS terminates at slider joint 36B having center axis 44F. A second end of rocker link R4 is tied to ground at revolute joint 38F. Revolute joint 38F can be affixed at any location along an arc intersecting center axis 44F and centered at position 54A. Some discrete locations along the arc are shown in the figure at positions 50A, 50B, 50C, 50D, and 50E. System 10F illustrates revolute joint 38F coupled to ground at position 50C. As such, revolute joint 34F travels in an arc shown at 52C and having an end at position 54A. Travel arcs 52A, 52B, 52C, 52D, and 52E indicate the paths of revolute joint 34F when rocker link R4 is tied to ground at positions 50A, 50B, 50C, 50D, and 50E, respectively. Travel arcs 52A, 52B, 52C, 52D, and 52E all converge at the TDC or BDC denoted by position 54A.

If rocker link R4 is tied to ground at position 50E, then both connecting rod link RS and rocker link R4 rock back and forth at joint 34F with rotation of crank link R2 and slider joint 36B exhibits zero displacement. This configuration is seen in system 10G shown in FIG. 4. Joint 38G can have a position along arc 46F and in the view shown, joint 38G intersects center axis 44G. In this configuration, joint 34G travels in an oscillatory manner along arc 52F with rotation of crank link R2.

Figure 4:
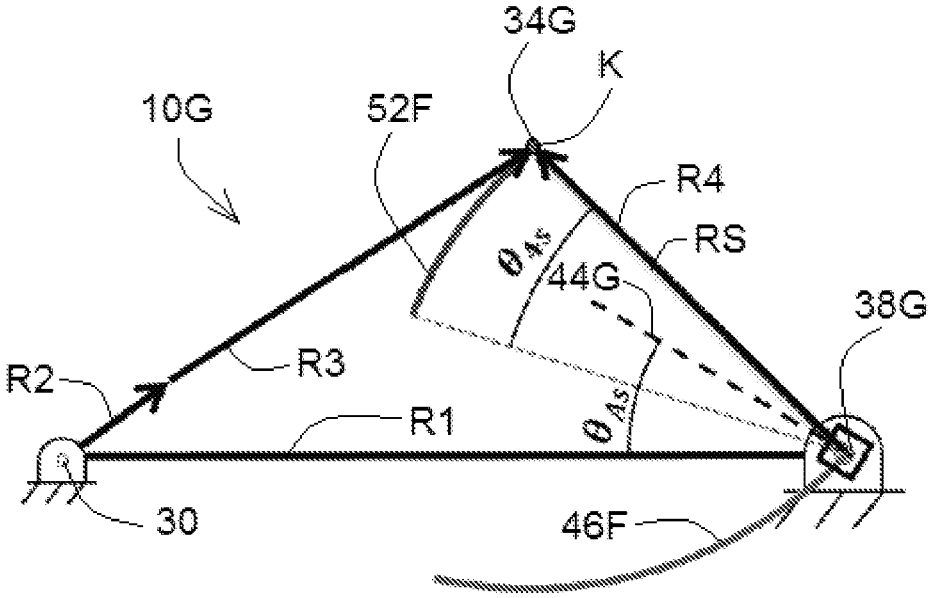
FIG. 4 illustrates a linkage configuration configured for zero displacement, according to one example.

A transmission angle can be defined as the acute angle between the relative velocity vectors of the output link and the coupler link. Force is best transmitted through these links when the transmission angle is 90°. There are two transmission angles of interest in this linkage, the angle between link R3 and link R4 and the angle between the connecting rod link RS and the slider joint. The minimum transmission angle between links R3 and R4 can be defined by setting the minimum and maximum lengths of the ground link, R1. The connecting rod to slider transmission angle can be calculated using standard position analysis techniques. The connecting rod to slider transmission angle is dependent on the angle of the center axis of the slider joint. With reference to FIG. 4, in the zero displacement configuration of the linkage, the connecting rod travels in arc about the slider, defined as $\theta_{4S}$ and here shown as 52F about the adjustable ground location at joint 38G. To maximize the slider transmission angle, the angle of the slider axis can be defined as $$\theta_{As} = \pi - \theta_{4max} - \frac{\theta_{4max} - \theta_{4min}}{2}$$

where $\theta_{4max}$ occurs at the overlapped case and $\theta_{4min}$ occurs at the extended case of the linkage. This selection of the slider axis is pointed at the center of this arc swung by R4, as seen in FIG. 4, resulting in an equal transmission at each extreme position.

The slider joint displacement can be defined as the distance traveled by the slider joint along the center axis of the slider joint from TDC to BDC. The maximum displacement of the slider joint is calculated when the adjustable ground pivot, at joint 38F in FIG. 3, is located at the furthest position from the zero displacement position of the ground pivot (position 50E), which, in this case, is position 50A. The maximum displacement can be compared to an inline crank-slider where the displacement of the slider is equal to twice the unit length of the crank.

The footprint of the linkage is defined as the two-dimensional area occupied by the linkage throughout the range of motion and includes the entirety of the linkage. This area is found by setting the extents of the linkage to a polygon and calculating the internal area. The units of the footprint are unit length squared.

Any value for the lengths of links R3 and R4 and their corresponding minimum transmission angle can be selected in any of the four configurations shown in FIGS. 2A-2D. For this reason, the minimum transmission angle for the revolute joint was set to 30°, for maintaining good force transmission. Thus, there are 2 infinities of solutions for each of the four solutions. A brute force optimization study can be conducted by varying the length of links R3 and R4 through reasonable bounds. Generally, the minimum slider transmission angle can be around 60°, which is similar to that of an internal combustion engine. Because of this, the footprint and maximum displacement became the primary optimization metrics of interest. To maximize power density of the pump, the ratio of stroke to footprint should be maximized. A peak value of stroke/footprint calculated for the extended case occurs with the axis of slide located at R1MAX. This corresponds to lengths of links R3 and R4 at 2.6 and 2.3 unit lengths respectively, where R2 length is deemed to have a value of 1. Other configurations have values as shown in the table below:

| Configuration | Maximum Stroke | Footprint | Stroke Footprint (Peak) | Minimum Slider Transmission Angle |
|---|---|---|---|---|
| Extended $R_{1max}$ | 1.28 | 9.95 | 0.13 | 63° |
| Extended $R_{1min}$ | 1.55 | 8.6 | .18 | 58° |
| Overlapped $R_{1max}$ | 2.1 | 8.83 | .24 | 56° |
| Overlapped $R_{1min}$ | 1.35 | 8.74 | .15 | 52° |
| Crank-Slider | 2 | ~5 | .4 | ~60° |

Figure 5:
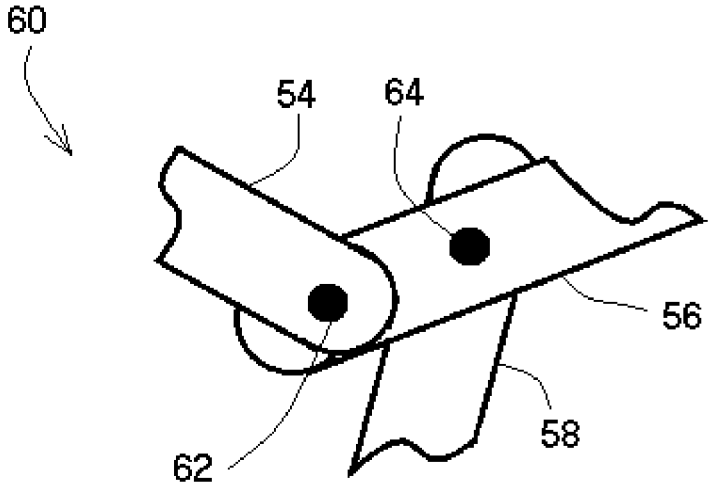
FIG. 5 illustrates a jointed linkage, according to one example.

FIG. 5 illustrates jointed linkage 60, according to one example. Linkage 60 includes bar 54, bar 56, and bar 58. In addition, linkage 60 includes revolute joint 62 and revolute joint 64. In the figure, bar 56 is coupled to bar 54 at joint 62 and coupled to bar 58 at joint 64. Linkage 60, as shown, depicts the three bars joined in a staggered arrangement in which joint 62 is independent of joint 64.

Bar 54, bar 56, and bar 58 can represent any of the links, couplings, connectors, or rods shown elsewhere in this document. For example, bar 54 can represent coupler link 22 (FIG. 1), bar 56 can represent connecting rod 24, and bar 58 can represent rocker link 26. In FIG. 1, coupler link 22, connecting rod 24, and rocker link 26 are each coupled to revolute joint 34A. Assuming that bar 54, bar 56, and bar 58 represent coupler link 22, connecting rod 24, and rocker link 26, or other combination, then rather than a single instance of joint 34A (FIG. 1), the system can include a staggered connection having two revolute joints. In such a case, connecting rod 24 and coupler link 22 are tied with a first revolute joint and rocker link 26 can be tied to either coupler link 22 or connecting rod 24 by a second revolute joint. In this instance, slider 36A (FIG. 1) does not have displacement that reaches zero but instead, has a non-zero displacement.

VARIOUS NOTES & EXAMPLES

In some of the examples shown, displacement variability is achieved by moving a ground pivot effectively changing a length of link R1. In other examples, displacement variability is achieved by changing the length of a moving link, such as the crank length, the coupler link, the connecting rod link, or the rocker link. It will also be appreciated, that the present subject matter can be configured to provide a constant displacement with variable rotary shaft speed. For example, an adjustable ground point (on the rocker link) or an adjustable link length can be configured to compensate for variations in crank shaft speed and thereby maintain a constant displacement volume. In this case, for example, the ground point position or the link length can be adjusted using a processor-controlled servo.

In one example, such as system 10A shown in FIG. 1, slider joint 36A can be coupled to piston 42 slidably engaged with cylinder 40. In this example, joint 36A can be viewed as a wrist pin on piston 42 moving within relatively stationary cylinder 40. In one example, slider joint 36A is coupled to a cylinder and a piston remains in a relatively stationary position. In either case, slider joint 36A can be viewed as coupled to a variable displacement chamber.

In one example, a system can be described as a crank-slider linkage having a jointed connecting rod affixed to a piston (or a cylinder) and coupled to a crank. The connecting rod can include a first link (sometimes referred to as a coupler link) and a second link (sometimes also referred to as a connecting rod). In this case, first link and second link are connected by a common revolute joint, and the common revolute joint is tied to ground by a binary rocker link.

As noted, FIG. 3 illustrates joint 38F and optional positions 50A, 50B, 50C, 50D, and 50E arranged in an arc. In one example, the positions are arranged linearly, curved, or in another configuration. In such examples, joint 36B can have a non-zero displacement or a displacement that does not reach a consistent stroke position of TDC.

Other configurations are also contemplated. For example, some configurations include link RS and link R4 on the same side of the longitudinal axis of link R3. Some configurations in which link RS and link R4 are on a common side of the longitudinal axis can be tailored to provide zero displacement and a uniform TDC (or BDC) position. Some configurations have link R4 and link RS disposed on opposing sides of the longitudinal axis of link R3. In these configurations, the system may be incapable of achieving zero displacement or uniform TDC position.

Example 1 can include or use an apparatus such as can include or use a crank-slider linkage and a rocker linkage. The crank-slider linkage includes a crank coupled to a slider by a jointed connecting rod. The jointed connecting rod includes a first link and a second link. The first link is coupled to the second link by a first revolute joint. The first link is coupled to the crank and has a longitudinal axis. The rocker link has a rocker end and a ground end. The rocker end is coupled to the jointed connecting rod. The ground end is coupled to ground by a second revolute joint. The rocker link and the second link are disposed on a common side of the longitudinal axis.

Example 2 can include, or can optionally be combined with the subject matter of Example 1, to optionally include wherein a position of the second revolute joint is adjustable.

Example 3 can include, or can optionally be combined with the subject matter of one or any combination of Example 1 or Example 2 to optionally include wherein the rocker end is coupled to the connecting rod at the first revolute joint.

Example 4 can include, or can optionally be combined with the subject matter of one or any combination of Examples 1 through 3 to optionally include wherein a position of the second revolute joint is adjustable along an arc.

Example 5 can include, or can optionally be combined with the subject matter of one or any combination of Examples 1 through 4 to optionally include wherein the second link is coupled to the slider and further wherein the second link and the rocker link are of equal length.

Example 6 can include, or can optionally be combined with the subject matter of one or any combination of Examples 1 through 5 to optionally include wherein the slider is disposed between a center axis of the crank and the second revolute joint.

Example 7 can include, or can optionally be combined with the subject matter of one or any combination of Examples 1 through 6 to optionally include wherein displacement of the slider decreases as a relative distance between the second revolute joint and the center axis of the slider decreases.

Example 8 can include, or can optionally be combined with the subject matter of one or any combination of Examples 1 through 7 to optionally include wherein the slider remains in a fixed position with crank rotation and with the second revolute joint aligned with a center axis of the slider.

Example 9 can include, or can optionally be combined with the subject matter of one or any combination of Examples 1 through 8 to optionally include wherein displacement decreases as a relative distance between the second revolute joint and the crank decreases.

Example 10 can include, or can optionally be combined with the subject matter of one or any combination of Examples 1 through 9 to optionally include wherein displacement increases as a relative distance between the second revolute joint and the crank decreases.

Example 11 can include or use an assembly such as can include or use a variable displacement chamber, a linkage, and rotary shaft. The variable displacement chamber has a piston in a cylinder. The linkage is coupled to the variable displacement chamber. The rotary shaft is coupled to the linkage. The linkage includes a coupler link coupled to the rotary shaft. The coupler link has a longitudinal axis and the coupler link is coupled to a connecting rod by a first revolute joint. The connecting rod is coupled to the chamber. The linkage includes a rocker link coupled to ground at a second revolute joint. The rocker link is coupled to the first revolute joint. The second revolute joint and the chamber are disposed on a common side of the longitudinal axis. The chamber has a displacement determined by a position of the second revolute joint relative to a center axis of the piston in the cylinder.

Example 12 can include, or can optionally be combined with the subject matter of Example 11, to optionally include wherein the variable displacement chamber is configured to carry a fluid.

Example 13 can include, or can optionally be combined with the subject matter of one or any combination of Examples 11 or 12 to optionally include wherein the rotary shaft is configured to be driven.

Example 14 can include, or can optionally be combined with the subject matter of one or any combination of Examples 11 through 13 to optionally include wherein the rocker link and the connecting rod are of equal length.

Example 15 can include, or can optionally be combined with the subject matter of one or any combination of Examples 11 through 14 to optionally include wherein the position is user selectable.

Example 16 can include, or can optionally be combined with the subject matter of one or any combination of Examples 11 through 15 to optionally include wherein at least one of the coupler link, the connecting rod, and the rocker link have an adjustable length.

Example 17 can include, or can optionally be combined with the subject matter of one or any combination of Examples 11 through 16 to optionally include wherein displacement decreases as a relative distance between the second revolute joint and the center axis decreases.

Example 18 can include, or can optionally be combined with the subject matter of one or any combination of Examples 11 through 17 to optionally include wherein the chamber maintains a fixed displacement with rotation of the rotary shaft and with the second revolute joint aligned with the center axis.

Example 19 can include, or can optionally be combined with the subject matter of one or any combination of Examples 11 through 18 to optionally include wherein displacement decreases as a relative distance between the second revolute joint and the rotary shaft decreases.

Example 20 can include, or can optionally be combined with the subject matter of one or any combination of Examples 11 through 19 to optionally include wherein displacement increases as a relative distance between the second revolute joint and the rotary shaft decreases.

Example 21 can include or use a system such as can include or use a four-bar crank-rocker assembly and a slider joint. The four-bar crank-rocker assembly has a first revolute joint configured to travel in a planar arc with rotation of the crank. The first revolute joint is coupled to the crank by a coupler link. The coupler link has a longitudinal axis. The first revolute joint is coupled to a rocker link. The rocker link is coupled to ground at a second revolute joint. The slider joint has a center axis and having a connecting rod coupled to the four-bar crank-rocker assembly. The second revolute joint and the slider joint are disposed on a common side of the longitudinal axis. Displacement of the slider joint is determined by a position of the second revolute joint relative to the center axis.

Example 22 can include, or can optionally be combined with the subject matter of Example 21 to optionally include wherein the connecting rod is coupled to the four-bar crank-rocker assembly at the first revolute joint.

Example 23 can include, or can optionally be combined with the subject matter of one or any combination of Examples 21 or 22 to optionally include wherein displacement decreases as a relative distance between the second revolute joint and the center axis decreases.

Example 24 can include, or can optionally be combined with the subject matter of one or any combination of Examples 21 through 23 to optionally include wherein the slider joint remains stationary with rotation of the rotary shaft and with the second revolute joint aligned with the center axis.

Example 25 can include, or can optionally be combined with the subject matter of one or any combination of Examples 21 through 24 to optionally include wherein the displacement decreases as a relative distance between the second revolute joint and the crank decreases.

Example 26 can include, or can optionally be combined with the subject matter of one or any combination of Examples 21 through 25 to optionally include wherein the displacement increases as a relative distance between the second revolute joint and the crank decreases.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. An apparatus comprising:

a crank-slider linkage, wherein the crank is coupled to the slider by a jointed connecting rod, the jointed connecting rod having a first link and a second link, the first link coupled to the second link by a first revolute joint, the first link coupled to the crank and having a longitudinal axis;

a rocker link having a rocker end and a ground end, the rocker end coupled to the jointed connecting rod and the ground end coupled to ground by a second revolute joint, the rocker link and the second link disposed on a common side of the longitudinal axis;

wherein the slider is configured for linear movement along a center axis, one end of the linear movement includes a first position; and wherein the second revolute joint is adjustable along an arc and wherein the location of the first position remains fixed with a change in the position of the second revolute joint along the arc.

2. The apparatus of claim 1 wherein the rocker end is coupled to the connecting rod at the first revolute joint.

3. The apparatus of claim 1 wherein the second link is coupled to the slider and further wherein the second link and the rocker link are of equal length.

4. The apparatus of claim 1 wherein displacement of the slider decreases as a relative distance between the second revolute joint and the center axis of the slider decreases.

5. The apparatus of claim 1 wherein the slider remains in a fixed position with crank rotation and with the second revolute joint aligned with a center axis of the slider.

6. The apparatus of claim 1 wherein displacement of the slider increases as a relative distance between the second revolute joint and the crank decreases.

7. An assembly comprising:

a variable displacement chamber having a piston in a cylinder;

a linkage coupled to the variable displacement chamber;

a rotary shaft coupled to the linkage, the linkage including a coupler link coupled to the rotary shaft, the coupler link having a longitudinal axis and the coupler link coupled to a connecting rod by a first revolute joint, the connecting rod coupled to the chamber, and the linkage including a rocker link coupled to ground at a second revolute joint and the rocker link coupled to the first revolute joint and further wherein the second revolute joint and the chamber are disposed on a common side of the longitudinal axis and further wherein the chamber has a displacement determined by a position of the second revolute joint relative to a center axis of the piston in the cylinder;

wherein the relative movement as to the piston and the cylinder is configured for linear movement along the center axis, one end of the linear movement includes a first position; and wherein the second revolute joint is adjustable along an arc and wherein the location of the first position remains fixed with a change in the position of the second revolute joint along the arc.

8. The assembly of claim 7 wherein the variable displacement amber is configured to carry a fluid.

9. The assembly of claim 7 wherein the rotary shaft is configured to be driven.

10. The assembly of claim 7 wherein the rocker link and the connecting rod are of equal length.

11. The assembly of claim 7 wherein the position is user selectable.

12. The assembly of claim 7 wherein at least one of the coupler link, the connecting rod, and the rocker link have an adjustable length.

13. The assembly of claim 7 wherein displacement decreases as a relative distance between the second revolute joint and the center axis decreases.

14. The assembly of claim 7 wherein the chamber maintains a fixed displacement with rotation of the rotary shaft and with the second revolute joint aligned with the center axis.

15. The assembly of claim 7 wherein displacement increases as a relative distance between the second revolute joint and the rotary shaft decreases.

16. A system comprising:

a four-bar crank-rocker assembly having a first revolute joint configured to travel in a planar arc with rotation of the crank, the first revolute joint coupled to the crank by a coupler link, the coupler link having a longitudinal axis, the first revolute joint coupled to a rocker link, the rocker link coupled to ground at a second revolute joint;

a slider joint having a center axis and having a connecting rod coupled to the four-bar crank-rocker assembly, wherein the second revolute joint and the slider joint are disposed on a common side of the longitudinal axis and further wherein displacement of the slider joint is determined by a position of the second revolute joint relative to the center axis; and wherein the slider joint is configured for linear movement along the center axis, one end of the linear movement includes a first position; and wherein the second revolute joint is adjustable along an arc and wherein the location of the first position remains fixed with a change in the position of the second revolute joint along the arc.

17. The system of claim 16 wherein the connecting rod is coupled to the four-bar crank-rocker assembly at the first revolute joint.

18. The system of claim 16 wherein displacement decreases as a relative distance between the second revolute joint and the center axis decreases.

19. The system of claim 16 wherein the slider joint remains stationary with rotation of the rotary shaft and with the second revolute joint aligned with the center axis.

20. The system of claim 16 wherein displacement increases as a relative distance between the second revolute joint and the crank decreases.

* * * * *